US008904691B1

(12) United States Patent
Kincel

(10) Patent No.: US 8,904,691 B1
(45) Date of Patent: Dec. 9, 2014

(54) FIREARM HANDGUARD ASSEMBLY

(71) Applicant: Bravo Company Mfg, Inc., Hartland, WI (US)

(72) Inventor: Eric Stephen Kincel, Las Vegas, NV (US)

(73) Assignee: Bravo Company Mfg, Inc., Hartland, WI (US)

( * ) Notice: Subject to any disclaimer, the term of this patent is extended or adjusted under 35 U.S.C. 154(b) by 0 days.

(21) Appl. No.: 13/951,317

(22) Filed: Jul. 25, 2013

(51) Int. Cl.
*F41C 23/00* (2006.01)
*F41C 23/16* (2006.01)

(52) U.S. Cl.
CPC ..... *F41C 23/16* (2013.01)
USPC ..... 42/71.01; 42/75.03

(58) Field of Classification Search
CPC ..... F41A 21/44; F41C 23/16
USPC ..... 42/71.01, 72, 75.01, 75.02, 75.03, 90
See application file for complete search history.

(56) References Cited

U.S. PATENT DOCUMENTS 7,770,317 B1 * 8/2010 Tankersley ..... 42/71.01
8,438,770 B2 * 5/2013 Troy ..... 42/71.01
8,607,490 B1 * 12/2013 Zinsner ..... 42/71.01
8,739,448 B2 * 6/2014 Kimmel et al. ..... 42/71.01
2011/0126443 A1 * 6/2011 Sirois ..... 42/90
2012/0124880 A1 * 5/2012 Leclair ..... 42/71.01
2012/0186123 A1 * 7/2012 Troy et al. ..... 42/71.01
2014/0026459 A1 * 1/2014 Yan et al. ..... 42/71.01
2014/0130390 A1 * 5/2014 Geissele ..... 42/71.01

FOREIGN PATENT DOCUMENTS

WO WO 2013010515 A1 * 1/2013 ..... F41C 23/16

* cited by examiner

*Primary Examiner* — Gabriel Klein
(74) *Attorney, Agent, or Firm* — Lewis Roca Rothgerber LLP

(57) ABSTRACT

A firearm handguard assembly system, the system comprising a handguard, wherein the handguard includes a first aperture and a second aperture on a first side, and a third aperture and a fourth aperture on a second side. A barrel nut which includes a groove around the outside diameter ahead of the threaded portion which is threaded onto the upper receiver to provide a mounting surface for the handguard. A locking mechanism is placed around the handguard containing the barrel nut, locked in place by at least a notched cross bolt and a locking cross bolt. The bolts are threaded through a first and second clamp block and the handguard. The bolts pass through the clearance afforded by the groove in the barrel nut without interfering with the various other components located above the barrel nut. An optional indexing plate may be placed between the barrel nut and the handguard to prevent rotation of the barrel nut.

3 Claims, 5 Drawing Sheets

FIREARM HANDGUARD ASSEMBLY

BACKGROUND

1. Field of the Invention

The present invention generally concerns firearm equipment. More particularly, the present invention relates to a firearm handguard assembly.

2. Description of the Related Art

Traditionally, a handguard is mounted to a firearm using an assembly that uses a basic clamp on the handguard (which may or may not be integrated with the handguard itself) with a slice-bottom design, wherein the bottom portion of the clamp is held together with screws, a two-sided slice design, or a multi-part clamp design. When the screws are tightened, the clamp bears down on the handguard, holding the handguard to the barrel nut. The barrel nut holds the barrel of the firearm in place and is attached to the upper receiver. However, this design is problematic. The tension created by the clamp holds the handguard in place on the barrel nut, but places stress on the upper area of the handguard which is weaker due to design constraints. This area expands as the clamping mechanism is tightened and more so when the firearm is in use due to the heat generated between the barrel of the firearm, which causes the stress imparted by the clamp to relax as the parts expand due to heat. Traditional designs have placed their hardware in a disadvantaged location due to the lack of clearance available between the various components on top of the barrel nut. There is, therefore, a need for an improved firearm handguard assembly system that obviates the shortcomings of the traditional clamping design.

Similarly, even when a handguard is properly mounted to a firearm, the movement of the handguard may loosen the barrel nut and could result in damage to the firearm. Several solutions have been offered to index the handguard to the upper receiver of the firearm. The most common solution is an anti-slip plate that is affixed to the barrel nut using several screws. This type of assembly can be complicated and time-consuming for the user. Yet another design is a handguard with an indexing tab (or "finger") that extends from the handguard and indexes to the upper receiver of the firearm. Therefore, there is a need for an indexing system that is simple and user-friendly.

SUMMARY OF THE CLAIMED INVENTION

A firearm handguard assembly system is disclosed. The system includes a handguard, wherein the handguard includes a first aperture and a second aperture on a first side, and a third aperture and a fourth aperture on a second side. A barrel nut which includes a groove around the outside diameter ahead of the threaded portion which is threaded onto the upper receiver to provide a mounting surface for the handguard. A locking mechanism is placed around the handguard containing the barrel nut, locked in place by at least a notched cross bolt and a locking cross bolt. The bolts are threaded through a first and second clamp block and the handguard. The bolts pass through the clearance afforded by the groove in the barrel nut without interfering with the various other components located above the barrel nut. An optional indexing plate may be placed between the barrel nut and the handguard to prevent rotation of the barrel nut.

DETAILED DESCRIPTION

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Figure 1A:
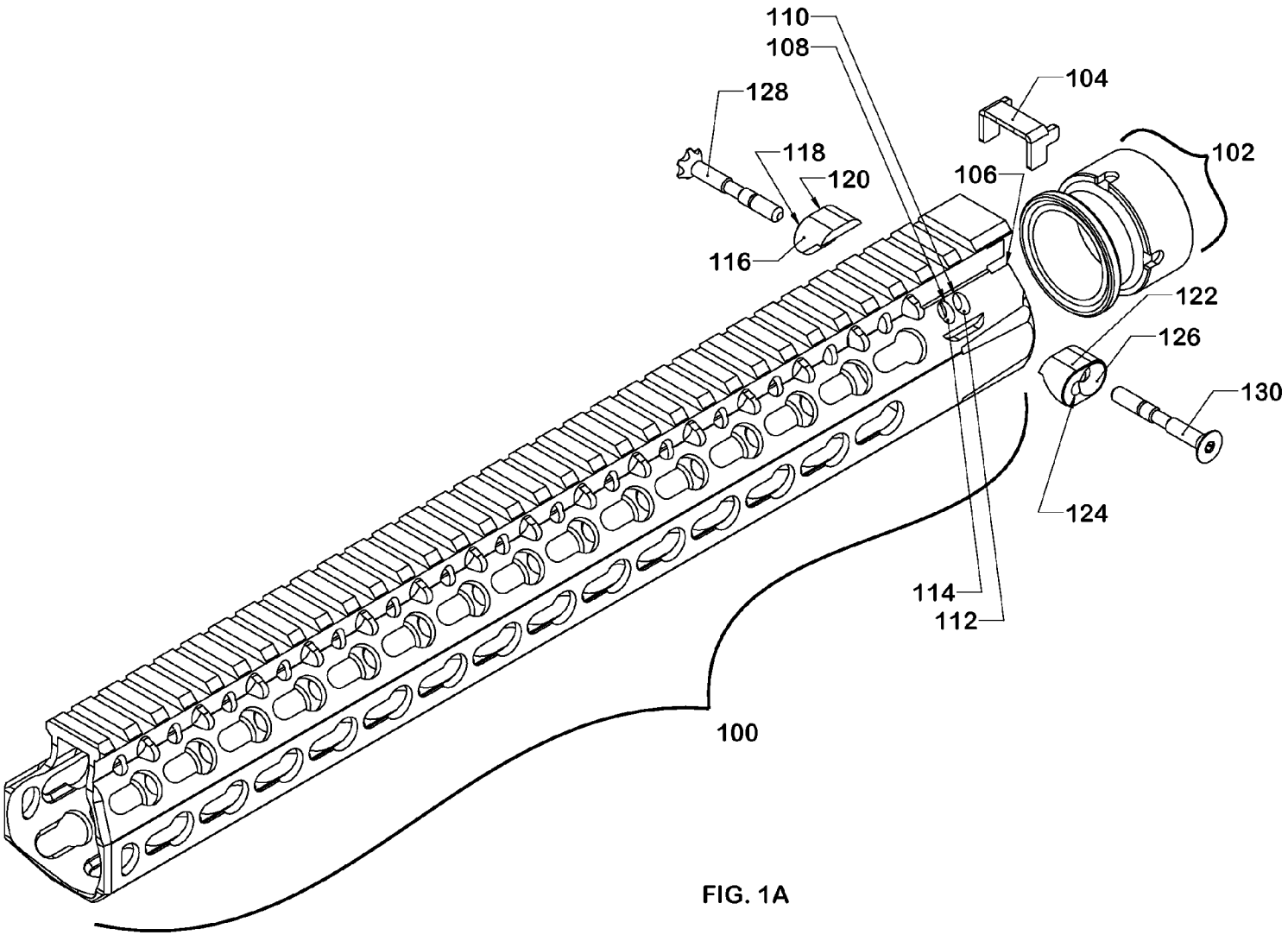
FIG. 1A illustrates an exploded view of an exemplary handguard assembly.

Referring now to FIG. 1A, illustrating an exploded view of a firearm handguard assembly system, a handguard 100 is coupled to a threaded end of barrel nut 102 to mount the upper receiver of a firearm (not shown) to handguard 100.

It is contemplated that any handguard may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium.

It is also contemplated that the handguard may contain KeyMod holes, a picatinny rail (also known as a MIL-STD-1913 accessory rail), or both, though neither is required for the handguard to function in connection with the present invention.

In an exemplary embodiment, the threaded end of barrel nut 102 is placed inside a first end of handguard 100.

The assembly may optionally include index plate 104. Index plate 104 may be placed between handguard 100 and the upper receiver of the firearm (not shown) by fitting it into an indentation 106 that runs the width of the handguard at the end that receives the barrel nut. Without an index plate, the movement of the handguard may loosen the barrel nut and could result in damage to the firearm. Use of index plate 104 eliminates rotation of handguard 100 during use.

A first end of handguard 100 contains apertures 108 and 110 on a first side, and apertures 112 and 114 on a second side. A first clamp block 116, containing a first aperture 118 and a second aperture 120, is placed flush with the first side of handguard 100, such that first aperture 118 is aligned with handguard aperture 108 and second aperture 120 is aligned with handguard aperture 110.

A second clamp block 122, containing a first aperture 124 and a second aperture 126, is placed flush with the second side of the handguard 100, such that first aperture 124 is aligned with handguard aperture 114 and second aperture 126 is aligned with handguard aperture 112.

The tip of notched cross bolt 128 is placed through aperture 118 on first clamp block 116 and threaded through handguard aperture 108, handguard aperture 114, and aperture 124 of second clamp block 122.

The tip of locking cross bolt 130 is placed through aperture 126 on second clamp block 122 and threaded through handguard aperture 112, handguard aperture 110, and aperture 120 of first clamp block 116.

During threading as described above, notched cross bolt 128 and locking cross bolt 130 pass under a gas tube (not shown) and preclude longitudinal movement of handguard 100, while clamping down on the body of handguard 100 to cause residual force between barrel nut 102 and handguard 100. The residual force prevents rotation and slippage during use.

Figure 1B:
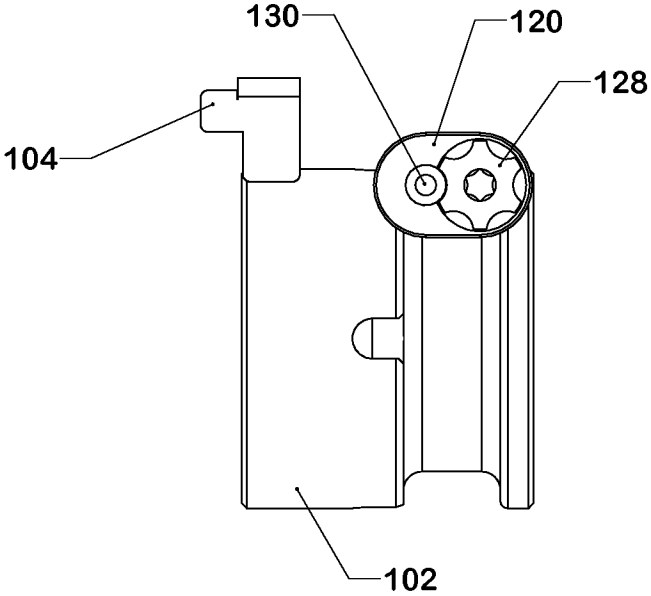
FIG. 1B illustrates a front view of a first clamp block of an exemplary handguard assembly.

Referring now to FIG. 1B, illustrating a front view of first clamp block 120, the head of notched cross bolt 128 interfaces with the tip of locking cross bolt 130, locking the bolt and clamp assembly to handguard 100.

Figure 1C:
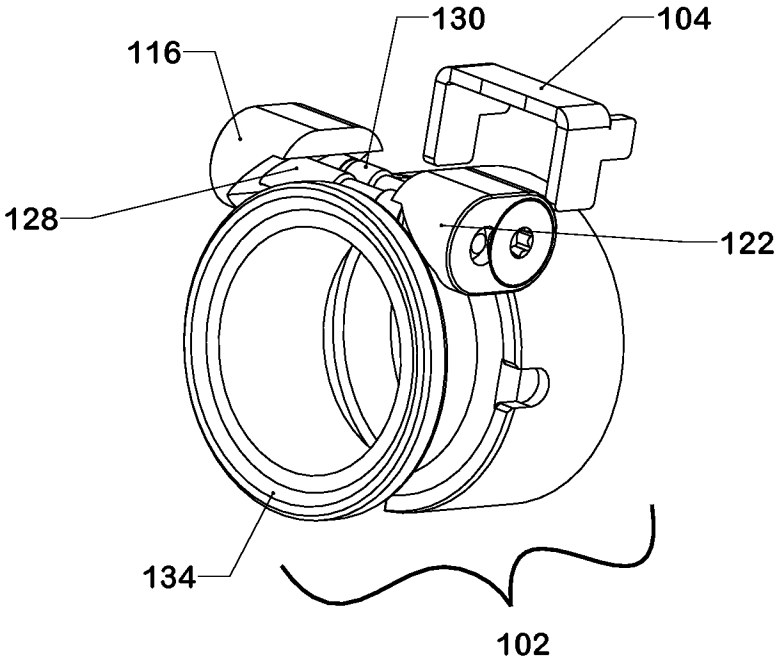
FIG. 1C illustrates a perspective view of an exemplary handguard assembly.

Referring now to FIG. 1C, illustrating a perspective view of an exemplary handguard assembly, the block and bolt assembly locks in place laterally in a groove 132 between the lip 134 of the threaded end barrel nut 102 and lip 136 of the smooth end of barrel nut 102.

Figure 1D:
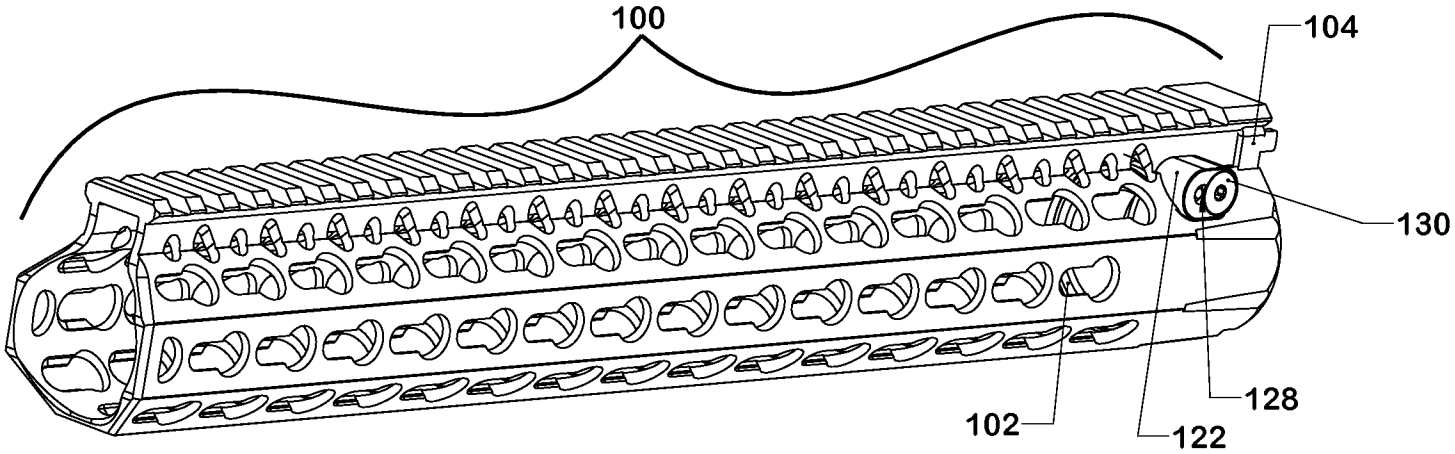
FIG. 1D illustrates a fully assembled firearm handguard assembly system.

Referring now to FIG. 1D, illustrating a fully assembled firearm handguard assembly system, the barrel nut 102 is secured inside handguard 100 with cross bolts 128 and 130, with indexing plate 104 in place, allowing handguard 100 to be fully indexed to the upper receiver of the firearm (not shown). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Figure 1E:
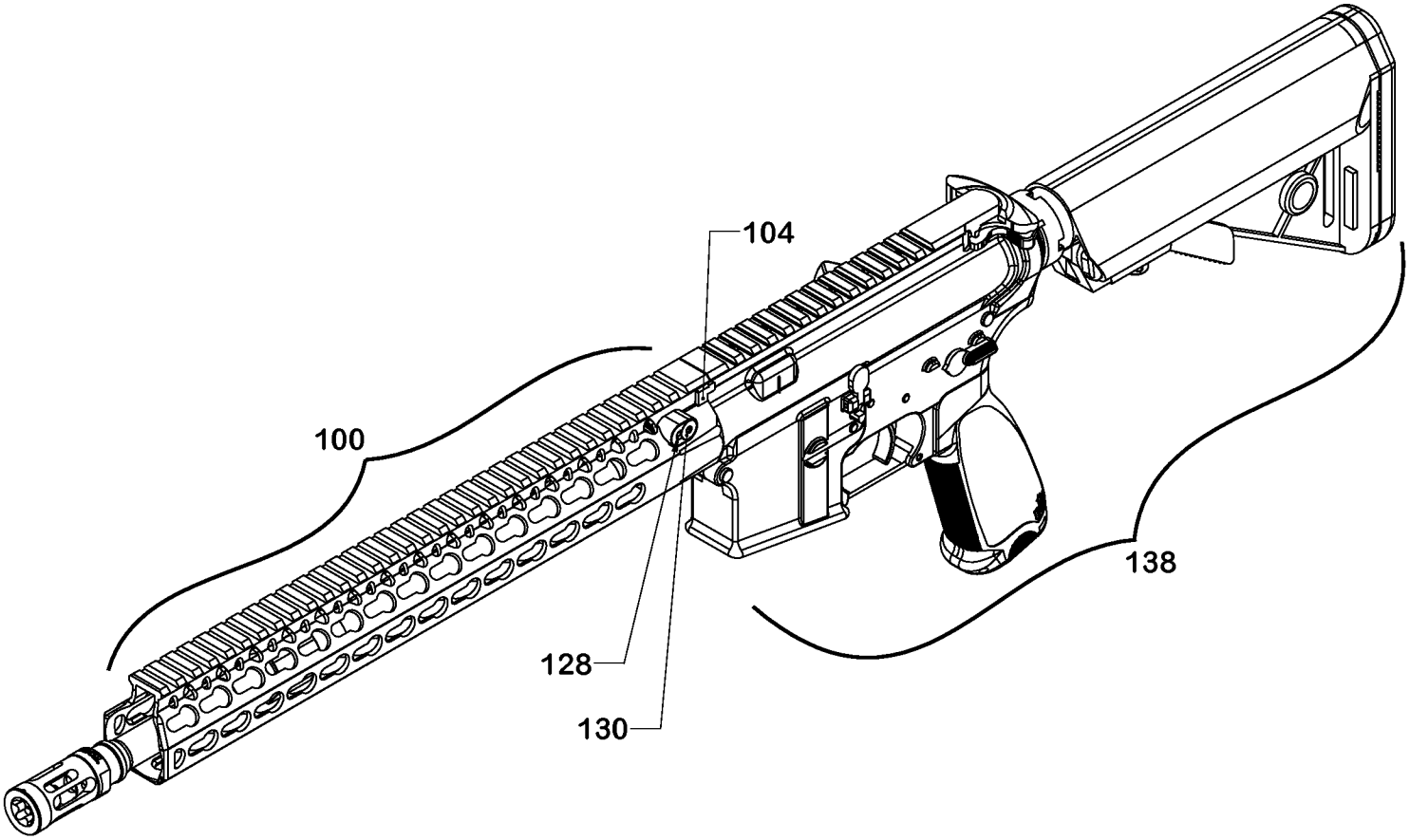
FIG. 1E illustrates a fully assembled firearm handguard assembly system on an exemplary firearm.

Referring now to FIG. 1E, illustrating a fully assembled firearm handguard on an exemplary firearm, the handguard 100 is secured to exemplary firearm 138 at its upper receiver with cross bolts 128 and 130, with indexing plate 104 in place.

An exemplary firearm may be an AR15, M16, M4, 416, or a variant thereof. The present invention may also be used with any firearm that uses a threaded portion of the forward area of the upper receiver and/or action over which may pass any portion of the operating assembly. By way of example, and not limitation, these firearms may include bolt action rifles for which the user may desire a handguard or fore-end with a top rail and superior clamping force to the receiver.

Although the exemplary embodiment described herein contains a block and bolt assembly that requires two blocks and two bolts, it is contemplated that more than two bolts may be used. It is also contemplated that the blocks may be integrated into the handguard body.

The barrel nut shown in FIGS. 1A-1E uses a radial groove long and deep enough to pass a multitude of bolts. Alternative embodiments of the barrel nut include, but are not limited to, a barrel nut design containing a plurality of apertures to allow the bolts to pass through the apertures and engage the clamping blocks; a barrel nut design with a plurality of flat cuts that create clearance for the bolts to pass; a barrel nut design with no forward flange but with a protrusion to support the bolts; a barrel nut design without any forward flange, no clearance cuts, and which may have bolts passing only in front of, or in front of and behind, the barrel nut in order to engage the apertures on either side of the handguard. The barrel nut and related metal mounting hardware made from any suitable structural material may be used in connection with the present invention, including without limitation steel (carbon and stainless) and titanium.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A firearm handguard assembly system, the system comprising:

a handguard including a first aperture and a second aperture on a first side, and a third aperture and a fourth aperture on a second side;

a barrel nut having a first threaded end and a second smooth end, the threaded end coupled to the handguard; and a first clamp block including at least two apertures and a second clamp block including at least two apertures, the first clamp block and the second clamp block coupled on either side of the handguard by:

a notched cross bolt having a head and a tip, the tip threaded through:

one of the at least two apertures on the second clamp block, the second aperture of the handguard, the fourth aperture of the handguard, one of the at least two apertures on the first clamp block, and a groove of the barrel nut; and a locking cross bolt having a head and a tip, the tip threaded through:

one of the at least two apertures on the first clamp block, the first aperture of the handguard, the third aperture of the handguard, one of the at least two apertures on the second clamp block, and a groove of the barrel nut, the tip of the locking cross bolt interlocking with the head of the notched cross bolt.

2. The system of claim 1, further comprising a notch on the upper edge of the handguard where the handguard is coupled to the barrel nut.

3. The system of claim 2, further comprising an indexing plate that fits in the notch and indexes the handguard to an upper receiver of a firearm.

* * * * *